United States Patent [19]

Gendreau et al.

[11] Patent Number: 4,546,980

[45] Date of Patent: Oct. 15, 1985

[54] PROCESS FOR MAKING A SOLID GOLF BALL

[75] Inventors: Paul M. Gendreau, Swansea; Francisco M. Llort, Dighton, both of Mass.; Raymond A. Berard, Portsmouth, R.I.

[73] Assignee: Acushnet Company, New Bedford, Mass.

[21] Appl. No.: 646,853

[22] Filed: Sep. 4, 1984

[51] Int. Cl.[4] ..... A63B 37/00

[52] U.S. Cl. ..... 273/218; 273/220; 273/235 R; 524/908; 525/274

[58] Field of Search ..... 525/274; 524/908; 273/218, 220, 235 R

[56] References Cited

U.S. PATENT DOCUMENTS

| | | | |
|---|---|---|---|
| 4,056,269 | 11/1977 | Pollitt et al. | 525/274 |
| 4,141,559 | 2/1979 | Melvin et al. | 273/235 R |
| 4,165,877 | 8/1979 | Miller et al. | 273/218 |
| 4,264,075 | 4/1981 | Miller et al. | 525/274 |
| 4,483,537 | 11/1984 | Hamada et al. | 524/908 |

*Primary Examiner*—Allan M. Lieberman
*Attorney, Agent, or Firm*—Lucas & Just

[57] ABSTRACT

A process of making a superior solid golf ball is disclosed. Two free radical initiators having different reactivities are used. A surprising and unexpected increase in initial velocity is obtained.

22 Claims, No Drawings

PROCESS FOR MAKING A SOLID GOLF BALL

The present invention relates to golf balls and in particular to a unique free radical initiator system used to make solid golf balls.

As used in the industry, the term "solid golf balls" refers to balls which do not have windings, i.e. they are either unitary, one piece golf balls or are multiple piece golf balls, e.g. with a solid unitary core and a separate cover.

For many years golf balls were made by winding a very long elastic thread about a core, which was either a solid or a liquid-filled balloon, and then molding a cover, notably of balata, thereabout. This is both a laborious and time consuming process and involves substantial expense. Because of this, manufacturers have been continually trying to reduce the complexity and cost of making a golf ball.

In the 60's it was thought that this had been accomplished with the inventions of James R. Bartsch, whose inventions are set forth in U.S. Pat. Nos. 3,438,933 and 3,313,545. The Bartsch patents teach a polymer backbone crosslinked by one or more organic monomers and these chemical compositions certainly had the greatest promise to that time of making a one piece solid golf ball. Many manufacturers spent millions of dollars trying to develop a successful commercial golf ball utilizing the Bartsch technology. While some golf balls did reach the marketplace, they were almost universally condemned because of their poor performance, particularly in terms of low initial velocity. At the present time, one piece golf balls have virtually, if not completely, disappeared from the marketplace except for unique situations such as golf driving ranges where poor performance is considered desirable by the operator since it makes it less likely that golf balls will be hit so far that they are lost.

In the early 70's it was discovered that golf balls could be made by crosslinking polymers with metal salts of unsaturated carboxylic acids and that such compositions were substantially better than the Bartsch composition in terms of golf ball properties such as initial velocity, rebound and the like. However, balls made from these compositions lacked the important element of durability. In boxing terms, they were similar to a fighter with a "glass jaw", i.e. if they were hit hard enough, they would fall apart. A number of manufacturers saw the advantage of using this technology, however, and toughened up the golf ball by putting on a cover of Surlyn resin, an ionomer made by duPont. While these balls were quite good, they were not as good as permitted by the United States Golf Association (USGA) in terms of initial velocity.

The applicants have now discovered that an improved solid golf ball can be made by crosslinking a polymer with a metal salt of an unsaturated carboxylic acid if a dual catalyst system is employed. The golf ball is characterized by excellent durability as well as high initial velocity.

To form the core of a two piece golf ball in accordance with standard industry techniques today, polybutadiene and a metal salt of a carboxylic acid are admixed and heated at an elevated temperature. Once the mixing is complete the admixture is cooled to a temperature below that of the maximum stable temperature of the free radical initiator which is to be added to the cooled mixture. The term "maximum stable temperature" means the highest temperature at which the decomposition of the free radical initiator is not significant. The free radical initiator is then added and the mixing is continued, after which the composition is molded.

The term free radical initiator is used herein to refer to a chemical which, when added to an admixture of a polymer and a metal salt of an unsaturated carboxylic acid, will cause the metal carboxylate to crosslink the polymer. Typical of these free radical initiators are peroxides such as dicumyl peroxide.

It has now been discovered that by using two or more free radical initiators with at least two having different reactivities in the curing process, a golf ball product having higher initial velocity is produced as compared to conventional golf balls produced using a single free radical initiator. Golf ball products made by the process of the present invention also have very good compression and durability.

As used herein, the term golf ball product is generic and includes unitary golf balls, cores of two piece golf balls, centers of wound golf balls and the like. The dual initiator system of the present invention may be used to form a unitary golf ball or a two or more part golf ball if desired. The composition of the present invention may be used for either the core or the shell cover of a two piece ball but best results are obtained when the composition of the present invention is used as the core with a standard cover such as of Surlyn ionomer resin.

It has been found to be essential that the two free radical initiators be substantially different, i.e. that they have substantially different reactivities at the same temperature. From another perspective, at a given temperature the two free radical initiators have different half lives. Similarly, one initiator has a lower reaction temperature than the other initiator to achieve the same half life.

The preferred initiators are peroxides and fall into two groups, a first group with short half lives and a second group with longer half lives for the same temperature. A temperature of 320° F. is a useful reference point since many literature reports of half lives are given at this temperature and, also, it is a common molding temperature. It is preferred that those of the second group have a half life which is at least three times as long as those of the first group at 320° F. and it is more preferred that the difference be at least six times. The half life of the initiator of the first group is preferably less than three minutes and the half life of the initiator of the second group is preferably at least about ten minutes, both times being at a temperature of 320° F.

A suitable peroxide belonging to the first group is 1,1-di(t-butylperoxy)-3,3,5-trimethyl cyclohexane which is commercially available from Noury Chemical Company under the name Trigonox 29/40 and from Vanderbilt under the name Varox 231 XL. The half life of 1,1-di-(t-butylperoxy)-3,3,5-trimethyl cyclohexane is about half a minute at 320° F. Other suitable peroxides in this group are t-butyl perbenzoate which has a half life of about two minutes at 320° F. and is commercially available from Pennwalt-Lucidol; n-butyl-4,4-bis(t-butylperoxy) valerate which has a half life of about two and a half minutes at 320° F. and is commercially available as Trigonox 17/40 from Noury or as Luperco 230 XL from Pennwalt-Lucidol; 1,1-di(t-butylperoxy) cyclohexane which has a half life of less than one minute at 320° F. and is commercially available from Pennwalt-Lucidol as Luperco 331 XL; and ethyl-3,3-di(t-butylperoxy) buterate which has a half life of less than one minute at 320° F. and is commercially available as Luperco 233 XL from Pennwalt-Lucidol.

Suitable peroxides belonging to the second group are: α,α'-bis(t-butylperoxy)diisopropyl benzene which has a half life at 320° F. of about eleven minutes and is commercially available from Hercules as Vulcup R or Vulcup-40KE; and t-butylcumyl peroxide which has a half life of about ten minutes at 320° F. and is commercially available from Noury under the name Trigonox T/40.

The total amount of initiators used in the mixture may be from about 0.2 to 10 parts by weight of the polymer content. A preferred range is about 0.4 to 5 parts. It will be understood that the total amount of initiators used will vary depending upon the particular end result desired and the specific initiators employed.

The ratio of the two free radical initiators to each other when mixed in the polybutadiene-metal carboxylic mixture is preferably from about 1:9 to about 9:1. A more preferred ratio is about 3:7 to about 7:3 and a most preferred ratio is about 1:1. The exact ratio used depends upon the two initiators used and the desired characteristics of the finished golf ball product.

In forming a composition according to the present invention, a polymer and a metal salt of unsaturated carboxylic acid are mixed together. The polymer is preferably formed from a diene monomer, and polybutadiene is the preferred polymer. The polybutadiene preferably has a cis 1,4 content above about 40% and more preferably above about 90%. The carboxylic acid is an α, β ethylenically unsaturated carboxylic acid having 3 to 8 carbon atoms, such as methacrylic, acrylic, cinnamic and crotonic acids of which acrylic and methacrylic are preferred. Suitable metal ions are sodium, potassium, magnesium, calcium, zinc, barium, aluminum, tin, zirconium, lithium and cadmium, of which sodium, zinc and magnesium are preferred. The metal ion is preferably introduced in the form of the salt of the carboxylic acid. The most preferred salts are zinc diacrylate and zinc dimethacrylate.

When the components are initially mixed together the temperature of the mixture is raised to a temperature at which the polybutadiene and the metal carboxylate can be readily admixed, suitably about 200° to 350° F. The mixing is continued at this elevated temperature until a good dispersion is achieved which is generally about 3 to 30 minutes. The temperature of the mixture is then reduced to below the lower of the maximum stable temperatures of the free radical initiators to be used. The initiators are then added to the mixture, and the mixture is mixed while being held below the maximum stable temperature of the lower stable temperature free radical initiator for about 3 to 15 minutes. The mass is then suitably milled into slabs or extruded into rods from which pieces are cut slightly larger and heavier than the desired golf ball. These pieces are placed in a golf ball product mold such as a ball cup mold or a ball core mold and cured at elevated temperature under pressure. A temperature of about 280° F. to 320° F. for a period of about 15 to 30 minutes has been found to be suitable. The pressure is not critical so long as it is sufficient to prevent the mold from opening during heating and curing.

These and other aspects of the present invention may be more fully understood with reference to the following examples.

EXAMPLES 1-6

A number of compositions were used to make golf ball cores. The following Table shows the parts by weight of the various ingredients expressed in parts by weight per 100 parts of polybutadiene.

TABLE I

| Ingredient | Example 1 | 2 | 3 | 4 | 5 | 6 |
|---|---|---|---|---|---|---|
| Polybutadiene | 100 | 100 | 100 | 100 | 100 | 100 |
| Zinc dimethacrylate | 31 | 31 | 31 | — | — | — |
| Zinc diacrylate | — | — | — | 26 | 26 | 26 |
| Zinc oxide | 24 | 24 | 24 | 22 | 22 | 22 |
| Trimethylolpropane Trimethacrylate | 3 | 3 | 3 | 3 | 3 | 3 |
| Vulcup-R | 8.7 | 0 | .4 | .2 | 0 | .1 |
| Trigonox 29/40 | 0 | 3.45 | 1.73 | 0 | .86 | .43 |

Zinc oxide is a filler and the trimethylolpropane trimethacrylate is a processing aid.

The ingredients without the initiators and trimethylolpropane trimethacrylate were mixed in a Shaw intermix for about 6 minutes at 250° F. for Examples 1-3 and 210° F. for Examples 4-6. The mixture was cooled to ambient temperature, the initiators and trimethylolpropane trimethacrylate were added and the mixture was mixed for an additional 2 minutes. Thereafter, the composition was mixed on a standard two roll mill for about 4 minutes. A slab about one-eighth of an inch thick was made from the mixture. Two inch by one and one-half inch pieces of the slab, weighing about 35 grams each, were cut from the slab, rolled, and placed in a standard golf ball core mold. The mold was closed under 60,000 pounds pressure at a temperature of about 320° F. and the composition was held under this temperature and pressure for about 20 minutes. Thereafter, the cores were removed from the mold and were allowed to stand for 24 hours at room temperature. The cores were tested and found to average the following physical properties:

TABLE II

| Property | Example 1 | 2 | 3 | 4 | 5 | 6 |
|---|---|---|---|---|---|---|
| Size (inches) | 1.511 | 1.525 | 1.517 | 1.513 | 1.524 | 1.520 |
| Weight (grams) | 34.53 | 35.30 | 35.12 | 34.45 | 35.12 | 35.04 |
| PGA Compression | 82 | 71 | 91 | 50 | 55 | 72 |
| Initial Velocity (ft/sec) | 251.2 | 251.1 | 252.2 | 250.3 | 250.9 | 253.4 |

The velocities obtained are comparable to those obtained in the standard United States Golf Association (USGA) test. In that test, a maximum initial velocity of not more than 255 feet per second is permitted. The PGA compression rating was obtained using a commercial PGA compression tester. Both of these measurement techniques are standard throughout the golf ball industry and are well known to those skilled in the art of golf ball manufacturing.

Golf balls were then made from the cores. A cover of an ionomer resin was molded about the cores to bring them up to an average diameter of 1.680-1.685 inches. The finished balls were tested and were found to average the following physical properties:

| Property | Example 1 | 2 | 3 | 4 | 5 | 6 |
|---|---|---|---|---|---|---|
| PGA Compression | 98 | 91 | 108 | 74 | 79 | 91 |
| Initial Velocity (ft/sec) | 252.3 | 252.2 | 253.5 | 252.2 | 252.5 | 254.8 |

It is readily apparent that the two initiator system as compared to the single initiator system gives superior results. In fact, the results are truly unexpected and surprising because the velocity of the balls made from the dual initiator system have a higher value than the value using either of the initiators alone. An increase of 0.5 feet per second is deemed significant and an increase of 1 foot per second is deemed very significant in the golf ball industry.

EXAMPLES 7–17

Two compositions were prepared using the basic ingredients of Examples 4–6 but without the initiators. After initial mixing, 0.2 parts of Vulcup R were added to one of the compositions and 0.86 parts of Varox 231XL were added to the other. The two compositions were then mixed in varying percentages and golf ball cores were made in the manner described from Examples 4–6. These cores had the following properties:

TABLE III

| Example | Percent of Composition: Vulcup R | Varox 231 XL | Size (in) | PGA Compression | Weight (gr) | Initial Velocity (ft/sec) |
|---|---|---|---|---|---|---|
| 7 | 100 | 0 | 1.512 | 62 | 34.73 | 251.8 |
| 8 | 90 | 10 | 1.519 | 75 | 35.03 | 253.0 |
| 9 | 80 | 20 | 1.515 | 80 | 34.99 | 253.2 |
| 10 | 70 | 30 | 1.520 | 82 | 35.20 | 254.2 |
| 11 | 60 | 40 | 1.520 | 83 | 35.26 | 254.2 |
| 12 | 50 | 50 | 1.520 | 82 | 35.21 | 254.0 |
| 13 | 40 | 60 | 1.520 | 80 | 35.21 | 254.1 |
| 14 | 30 | 70 | 1.520 | 79 | 35.29 | 254.0 |
| 15 | 20 | 80 | 1.521 | 77 | 35.31 | 253.8 |
| 16 | 10 | 90 | 1.520 | 74 | 35.28 | 253.4 |
| 17 | 0 | 100 | 1.523 | 68 | 35.34 | 252.6 |

As can be seen, the initial velocity is higher for ball cores made from a mixture of the two initiators than from either of the individual initiators alone throughout the range of 90:10 to 10:90 and is better at 70:30 to 30:70. Again, this shows the surprising and unexpected results which are obtained with the present invention.

EXAMPLE 18

In this instance unitary golf balls were made using the composition of Example 6 except that the zinc diacrylate was 30 parts, the zinc oxide was 12 parts and there was no processing aid. The golf balls were found to average the following properties:

| | |
|---|---|
| Size (inches) | 1.682 |
| Weight (gr.) | 46.0 |
| PGA Compression | 88 |
| Initial Velocity (ft/sec) | 255.9 |

As can be seen, these balls had such high initial velocities that they are "illegal" under USGA rules. These balls can, however, be sold as novelties such as "hot" balls or they can be slowed down to make them legal for USGA play. Slowing them down can suitably be accomplished by adjusting the total amount of free radical initiator.

The dual initiator system of the present invention may also be used in a two or more part golf ball if desired. The composition of the present invention may be used for either the core or the shell cover of a two piece ball but best results are obtained when the composition of the present invention is used as the core with a standard cover such as of Surlyn ionomer resin.

Those skilled in the art of rubber curing will appreciate that the double cure system herein disclosed for golf balls is not limited to golf balls per se and may be applied in other areas where a free radical initiator is used in curing rubber products, especially those which are relatively thick.

It will be understood that the claims are intended to cover all changes and modifications of the preferred embodiments of the invention, herein chosen for the purpose of illustration, which do not constitute departure from the spirit and scope of the invention.

What is claimed is:

1. In the method of making a golf ball product from an admixture of polybutadiene and a metal salt of an unsaturated carboxylic acid the improvement comprising the use of at least two free radical initiators, one said free radical initiator having a half life at 320° F. which is longer than the half life at 320° F. of the other said free radical initiator, the two free radical initiators being present in the ratio of about 1:9 to about 9:1, the two free radical initiators being sufficiently different in half life to yield a golf ball product having an initial velocity at least 0.5 foot per second higher than the initial velocity of the same golf ball product made with either one of said initiators alone.

2. The method of claim 1 wherein one of the free radical initiators has a half life which is at least three times greater than the half life of one of the others at 320° F.

3. The method of claim 1 wherein two said free radical initiators comprise a first said free radical initiator which has a half life of less than about 1 minute at 320° F. and a second said free radical initiator which has a half life of greater than about 10 minutes at 320° F.

4. The method of claim 1 wherein said first said free radical initiator is selected from the group consisting of 1,1-di(t-butylperoxy)-3,3,5-trimethyl cyclohexane, t-butyl perbenzoate, n-butyl-4,4-bis(t-butylperoxy) valerate, 1,1-di(t-butylperoxy) cyclohexane and ethyl-3,3-di (t-butylperoxy) buterate, and said second said free radical initiator is selected from the group consisting of $\alpha,\alpha'$-bis (t-butyl peroxy) diisopropyl benzene and t-butylcumyl peroxide.

5. The method of claim 3 wherein said first free radical initiator is 1,1-di(t-butylperoxy) 3,3,5-trimethyl cyclohexane and said second free radical initiator is $\alpha,\alpha'$-bis(t-butylperoxy) diisopropyl benzene.

6. The method of claim 1 wherein said polybutadiene has a cis 1,4 polybutadiene content above about 90%, and said unsaturated carboxylic acid is zinc dimethacrylate or zinc diacrylate.

7. The method of claim 1 wherein the golf ball product is a unitary golf ball.

8. The method of claim 1 wherein the golf ball product is the core of a two piece golf ball.

9. A golf ball product formed from a mixture comprising polybutadiene and a metal salt of an unsaturated carboxylic acid, said mixture having been cured with at least two free radical initiators, one said free radical initiator having a half life at 320° F. which is longer than the half life at 320° F. of the other said free radical initiator, the two free radical initiators being present in the ratio of about 1:9 to about 9:1, the two free radical initiators being sufficiently different in half life to yield a golf ball product having an initial velocity at least 0.5 foot per second higher than the initial velocity of the same golf ball product made with either one of said initiators alone.

10. The golf ball product of claim 9 wherein one of the free radical initiators has a half life which is at least three times greater than the half life of one of the others at 320° F.

11. The golf ball product of claim 9 wherein two said free radical initiators comprise a first said free radical initiator which has a half life of less than about 1 minute at 320° F. and a second said free radical initiator which has a half life of greater than about 10 minutes at 320° F.

12. The golf ball product of claim 9 wherein two said free radical initiators comprise a first said free radical initiator selected from the group consisting of 1,1-di(t-butylperoxy)-3,3,5-trimethyl cyclohexane, t-butyl perbenzoate, n-butyl-4,4-bis (t-butylperoxy) valerate, 1,1-di(t-butylperoxy cyclohexane and ethyl-3,3-di (t-butylperoxy) buterate, and a second said free radical initiator selected from the group consisting of $\alpha,\alpha'$-bis(t-butylperoxy) diisopropyl benzene and t-butylcumyl peroxide.

13. The golf ball product of claim 11 wherein said first free radical initiator is 1,1-di(t-butylperoxy) 3,3,5-trimethyl cyclohexane and said second free radical initiator is $\alpha,\alpha'$-bis(t-butylperoxy) diisopropyl benzene.

14. The golf ball product of claim 9 wherein said polybutadiene has a cis 1,4 polybutadiene content above about 90%, and said unsaturated carboxylic acid is zinc dimethyacrylate or zinc diacrylate.

15. The golf ball product of claim 9 wherein the golf ball product is a unitary golf ball.

16. The golf ball product of claim 9 wherein the golf ball product is the core of a two piece golf ball.

17. In the method of making a golf ball product from an admixture of polybutadiene and a metal salt of an unsaturated carboxylic acid the improvement comprising the use of at least two free radical initiators, one said free radical initiator having a half life at 320° F. which is at least three times longer than the half life at 320° F. of the other said free radical initiator, the two free radical initiators being present in the ratio of about 1:9 to about 9:1 and the total amount of free radical initiator being from about 0.2 to 10 parts by weight of the polybutadiene.

18. The method of claim 17 wherein the said ratio is from about 3:7 to about 7:3 and the total amount of free radical initiator is from about 0.4 to 5 parts by weight of the polybutadiene.

19. A golf ball product formed from an admixture of polybutadiene and a metal salt of an unsaturated carboxylic acid the improvement comprising the use of at least two free radical initiators, one said free radical initiator having a half life at 320° F. which is at least three times longer than the half life at 320° F. of the other said free radical initiator, the two free radical initiators being present in the ratio of about 1:9 to about 9:1 and the total amount of free radical initiator being from about 0.2 to 10 parts by weight of the polybutadiene.

20. The golf ball product of claim 19 wherein the said ratio is from about 3:7 to about 7:3 and the total amount of free radical initiator is from about 0.4 to 5 parts by weight of the polybutadiene.

21. In the method of making a golf ball product from an admixture of polybutadiene and a metal salt of an unsaturated carboxylic acid the improvement comprising the use of at least two free radical initiators, the two free radical initiators being present in sufficient quantity and being sufficiently different in half life and being in a ratio which yields a golf ball product having an initial velocity at least 0.5 foot per second higher than the initial velocity of the same golf ball product made with either one of said initiators alone.

22. A golf ball product formed from an admixture of polybutadiene and a metal salt of an unsaturated carboxylic acid the improvement comprising the use of at least two free radical initiators, the two free radical initiators being present in sufficient quantity and being sufficiently different in half life and being in a ratio which yields a golf ball product having an initial velocity at least 0.5 foot per second higher than the initial velocity of the same golf ball product made with either one of said initiators alone.

* * * * *

UNITED STATES PATENT AND TRADEMARK OFFICE

CERTIFICATE OF CORRECTION

PATENT NO. : 4,546,980

DATED : October 15, 1985

INVENTOR(S) : Paul M. Gendreau et al.

It is certified that error appears in the above-identified patent and that said Letters Patent is hereby corrected as shown below:

Column 4, Table I, line 11 of the Table, "8.7" should be --.8--.

Column 7, line 26, "di(t-butylperoxy" should be --di(t-butylperoxy)--.

Signed and Sealed this

*Tenth* Day of *June 1986*

[SEAL]

*Attest:*

DONALD J. QUIGG

*Attesting Officer*

*Commissioner of Patents and Trademarks*